US005638978A

United States Patent [19]

Cadiente

[11] Patent Number: 5,638,978

[45] Date of Patent: Jun. 17, 1997

[54] SHIPPING CONTAINER

[75] Inventor: Anthony Cadiente, Salinas, Calif.

[73] Assignee: Sambrailo Paper Company, Watsonville, Calif.

[21] Appl. No.: 591,426

[22] Filed: Jan. 19, 1996

[51] Int. Cl.[6] ..... B65D 5/56

[52] U.S. Cl. ..... 220/418; 220/416; 279/23 BT; 279/186; 279/199

[58] Field of Search ..... 229/23 BT, 186, 229/199; 220/408, 410, 416, 418, 468, 902

[56] References Cited

U.S. PATENT DOCUMENTS

| | | | |
|---|---|---|---|
| 1,816,321 | 7/1931 | Foss | 220/418 |
| 1,971,863 | 8/1934 | Lupton | 229/199 |
| 2,987,236 | 6/1961 | Strive | 229/199 |
| 3,445,051 | 5/1969 | Goldman | 220/468 |
| 4,176,745 | 12/1979 | Stollberg | 206/423 |
| 4,889,252 | 12/1989 | Rockom et al. | 220/418 |
| 4,941,572 | 7/1990 | Harris | 206/423 |
| 5,009,326 | 4/1991 | Reaves et al. | 220/410 |
| 5,029,708 | 7/1991 | Alonso et al. | 206/423 |
| 5,054,234 | 10/1991 | Cassells | 47/69 |
| 5,111,957 | 5/1992 | Hollander et al. | 220/410 |
| 5,115,915 | 5/1992 | Harris | 206/524 |
| 5,148,918 | 9/1992 | Weder et al. | 206/423 |
| 5,201,868 | 4/1993 | Johnson | 220/410 |
| 5,217,117 | 6/1993 | Tsuji | 206/423 |
| 5,255,784 | 10/1993 | Weder et al. | 206/423 |
| 5,379,549 | 1/1995 | Carcich et al. | 47/84 |

*Primary Examiner*—Gary E. Elkins
*Attorney, Agent, or Firm*—LaRiviere, Grubman & Payne

[57] ABSTRACT

Insulated waterproof container for the shipment of produce which is especially suited to the storage and shipment of floral produce. The container of the present invention includes a tray for receiving therein floral or other produce, and a cover for covering the tray. Both tray and cover include insulating panels which, when the tray and cover are assembled, form a substantially continuous insulating barrier on the interior of the container. The tray is rendered waterproof by forming if of waterproof materials, or by applying a waterproof coating thereto. The watertight integrity of the tray is further ensured by the formation of a gusset at each corner which serve to render at least a portion of the tray watertight. The tray and cover may include ventilation ports for the cooling of produce stored inside the tray.

1 Claim, 3 Drawing Sheets

SHIPPING CONTAINER

TECHNICAL FIELD

The present invention relates to a shipping container for cut flowers or other perishable produce which benefit from refrigerated shipping. Specifically, the present invention teaches an insulated shipping container having improved water resistance and water retention capabilities for the shipping and storage of damp produce, or produce which is prone to give off water during storage.

BACKGROUND ART

A long sought after goal in the floral industry has been the extension of the shelf life of cut floral produce during post-harvest shipment. Inherent in any such endeavor are the requirements to manage both temperature and humidity within containers in which the floral produce is stored and shipped.

Temperature control may require either cooling, or more rarely warming of produce post harvest. Cooling may be initially effected by the introduction of ice, cold water, or cold air. The initial cooling of produce may with equal facility be effected by the packing of the floral produce with ice, ice slurry, or cold water, or other cooling methods known to those of ordinary skill in the art.

One shipping container which readily adapts itself to a vacuum process for using cold air cooling is taught by Stollberg in U.S. Pat. No. 4, 176,745. As taught by the '745 patent, a shipping container comprising a tray and separable cover sections are provided with closure flaps on both the tray and cover sections. When the cover is in place on the tray, the two flaps, being in registry, provide communication between the interior of the shipping container and the ambient temperature. Such communication may then be used to withdraw, by vacuum, the relatively warm air from inside the container having stored within it floral produce. The relatively warm air is replaced with relatively cool or cold air from within a refrigerated storage facility.

The container taught by '745 is, in many respects, typical of container of containers in general use in the floral industry. Referring now to FIGS. 5 and 6 of that reference, it will be appreciated that the tray and cover taught therein are formed of a single piece of cut and formed corrugated cardboard which has been preformed by cutting and creasing so as to enable its assembly into its final form. '745 teaches, for instance at Column 2, lines 65–67, that "any suitable expedient such as glue, staples, etc., may be employed to secure the flaps to the side walls". From the study of those figures, it will be apparent that the container taught by Stollberg will be prone to leakage of any water from within the container. By way of example, but not limitation, such water or other fluids may have been injected in the container in the form of cold water, ice slurry, melted ice, or the water given off by respiration or decomposition of the floral produce stored within.

In addition to the maintenance of a reasonably optimal storage and shipping temperature, the attainment and maintenance of a reasonably optimal humidity or moisture level is also of critical importance to the prolonged storage and shelf life of most floral produce, indeed of most fresh produce of all kinds. To this end, a number of methodologies have been adapted to retain moisture about produce. A common means to this end is the providing, within a shipping container, of a moisture barrier. One such barrier is taught in U.S. Pat. No. 5,379,549 to Carcich, et al. As taught by Carcich, cut produce as well as a moisture retention block is encompassed in a moisture barrier for maintaining the proper humidity of the floral produce stored within. This moisture barrier, comprising for instance a polyethylene sheet bag, is then enclosed in a box, preferably of corrugated fiber board construction, which is in turn sealed.

A problem encountered by the use of commonly available plastic bags, for instance polyethylene sheet bags, occurs when the floral produce being stored within contains projections such a spines or thorns which might tend to puncture or tear the bag into which the floral produce is inserted. Depending upon the degree to which the integrity of the moisture barrier is compromised, humidity and liquid retention may be degraded or lost entirely.

The moisture barrier, if undamaged, could serve to retain water within the shipping container. However, from the previous discussion it will be apparent that the storage of many produce types within plastic bags renders them extremely susceptible to damage and hence leakage.

Some floral produce has been shipped in insulated containers to further prolong its shelf life by maintaining a desired temperature for extended periods of time. Such insulated containers have taken the form of plastic structures formed of, for instance, expanded polystyrene bead foam. Such foam containers are exceptionally prone to damage during shipment so another alternative has been to further package the foam container within, for instance, a corrugated cardboard container to minimize damage to the foam containers. This alternative has the disadvantage of requiring a significant investment in shipping containers per quality of floral produce shipped.

What is needed is a low cost, insulated container for the storage of floral produce which is capable of extending the storage and shelf life of the produce stored within by thermally insulating the produce form the ambient temperature. Such a container should not only be in and of itself water resistant, but should be capable of retaining within a sufficient quantity of water without leakage. Containers should be capable of assembly using commonly found assembly methods and should be capable of being compactly stored and shipped prior to use by the grower or packer.

DISCLOSURE OF INVENTION

The present invention comprises a produce container especially suitable for the refrigerated storage of damp or wetted floral produce. The container consists of a tray section and a cover section. These sections may be separate structures or, in the alternative, may form a substantially one-piece container. The tray and cover are formed of materials commonly found in the packaging arts including, but not limited to, fiberboard, cardboard, chipboard, pasteboard, corrugated cardboard, extruded, expanded, and vacuum formed plastics, as well as metals and metal foils.

The interior of the tray is rendered substantially water resistant or water proof either by the selection of a water proof material for its construction, or by the formation of a water proof layer over the interior surface of the tray. The tray is cut and formed so as to provide gussets at each corner which, when folded and assembled, render at least a portion of the tray watertight. Further attached to the interior surface of the tray are at least one, and preferably a plurality, of insulating foam panels. The panels are arranged such that when the tray is folded and assembled the foam panels form a substantially continuous insulating barrier inside the tray. The tray may be assembled using adhesives, staples, stitching, or other assembly methods well known to those of ordinary skill in the art.

In one embodiment of the present invention, the tray is fitted with at least one, and preferably a plurality of ventilation ports at the ends of the trays. These ventilation ports are used to inject coolant in the form of the previously discussed cold air, ice, or ice slurry into the tray.

The cover, as previously discussed, may be formed as a separate structure or, alternatively, may be formed integrally with the tray of the present invention. Where the cover is formed as a separate structure, it takes the shape of a second tray assembly suitable sized to slidably receive therein the previously discussed tray. Attached to the top of the tray is at least one insulating panel which, when the cover is installed on the tray, completes the thermal insulating barrier within. The cover may be formed of any of the previously discussed materials and, like the tray, may be assembled using the previously discussed assembly methodologies.

Where the tray is fitted with ventilation ports, the cover is similarly furnished. Where these ports are fitted, the cover ventilation ports are so situated as to be in registry with the tray ports when the cover is in place on the tray.

Other features of the present invention are disclosed or apparent in the section entitled: "BEST MODE FOR CARRYING OUT THE INVENTION."

BRIEF DESCRIPTION OF DRAWINGS

For fuller understanding of the present invention, reference is made to the accompanying drawing in the following detailed description of the Best Mode of Carrying Out the Invention. In the drawing.

Figure 1:
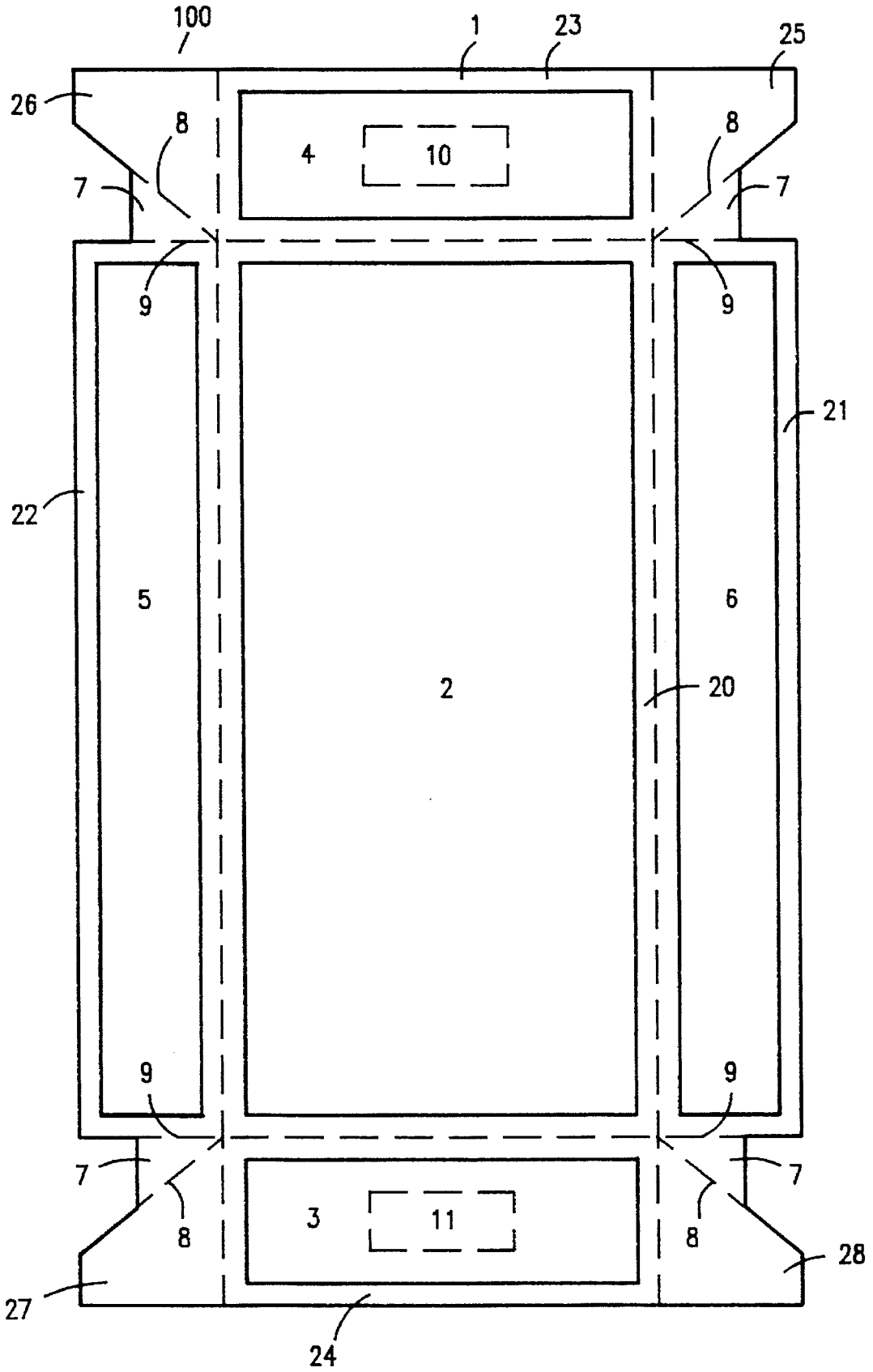
FIG. 1 is a plan view of the tray according to the present invention.

Reference numbers refer to the same or equivalent parts of the present invention throughout the several figures of the drawing.

BEST MODE FOR CARRYING OUT THE INVENTION

Referring now to FIG. 1, a plan view of the tray according to the present invention is shown. In a preferred embodiment of the present invention tray 100 comprises a first sheet of corrugated cardboard 1 having a minimum edge crush test value of 32 pounds. An interior surface of tray 100 is rendered water proof by coating it with wax (not shown) using a curtain coating process. In a preferred embodiment of the present invention, MobilKoat +31® was utilized. Cardboard sheet 1 is formed by cutting and creasing in the manner well known to those of ordinary skill in the art. After cutting and forming, tray 1 of the present invention further consists of a bottom section 20, side sections 21 and 22, and end sections 23 and 24.

Attached to bottom 20 is an insulating sheet of 2. Additional sheets of polystyrene foam are attached to the sides and ends at 3, 4, 5, and 6. While ¼ inch thick Falcon Foam Co. Type I polystyrene foam was used in a preferred embodiment of the present invention, alternative insulating materials include, but are not limited to various poly- and monomeric foams; Celotex®; bagasse panels; FibreGlas® and other insulating materials well known to those of ordinary skill in the art. Panels 2 through 6 are attached to sheet 23 by means of hot melt adhesive. In a preferred embodiment Adhesive Products Co. No. 74DZX hot melt adhesive was utilized.

A gusset 7 is provided at each comer flap, 25 through 28, to maintain the watertight integrity of tray 1 when assembled. Gusset 7 is formed by the intersection of crease lines 8 and 9. In a preferred embodiment of the present invention, gusset 7 provides watertight integrity for approximately one half of the height the assembled tray. However, it will be apparent to those of ordinary skill in the art that the desired degree of watertight integrity may be increased or decreased by the height to which gusset 7 is formed.

Tray 100 is fitted with a pair of ventilation ports 10 and 11 at ends 23 and 24. Ventilation ports 10 and 11 communicate through both sheet 1 and insulating sheets 3 and 4.

Figure 2:
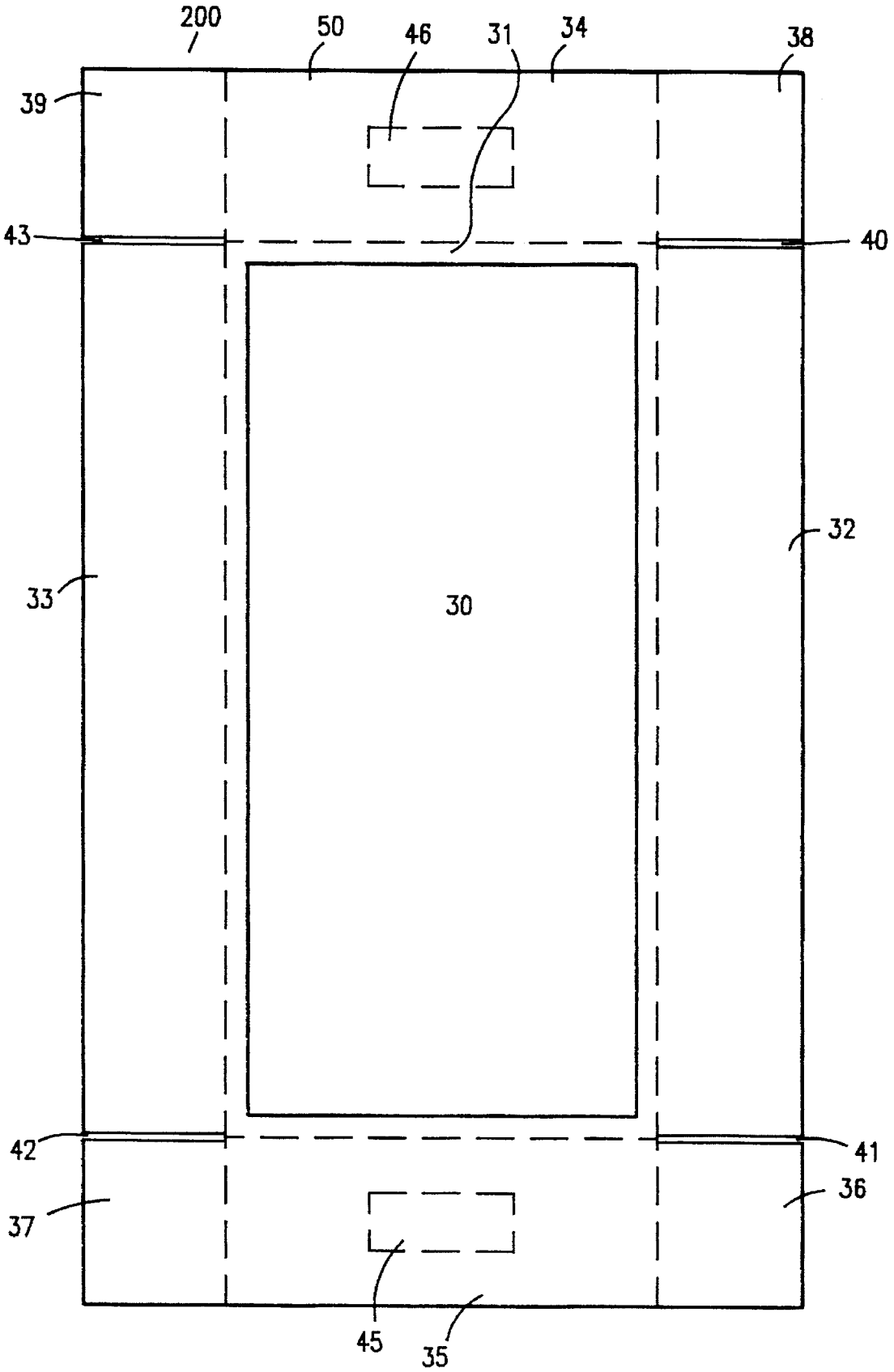
FIG. 2 is a plan view of the cover according to the present invention.

Referring now to FIG. 2, cover 200 of the present invention is shown. In a preferred embodiment, cover 200 comprises a second sheet of corrugated cardboard 50 having attached to a center section a sheet of insulating material 30. Cover 200 is formed by cutting and creasing sheet 50 including four assembly slots 40 through 43 and ventilation ports 45 and 46. Ports 45 and 46 are so formed as to be in registry with ports 10 and 11 (now shown) of tray 100 when cover 200 is installed thereon. Cover 200 is assembled by folding and stapling in a manner well known to those of ordinary skill in the art.

Figure 3:
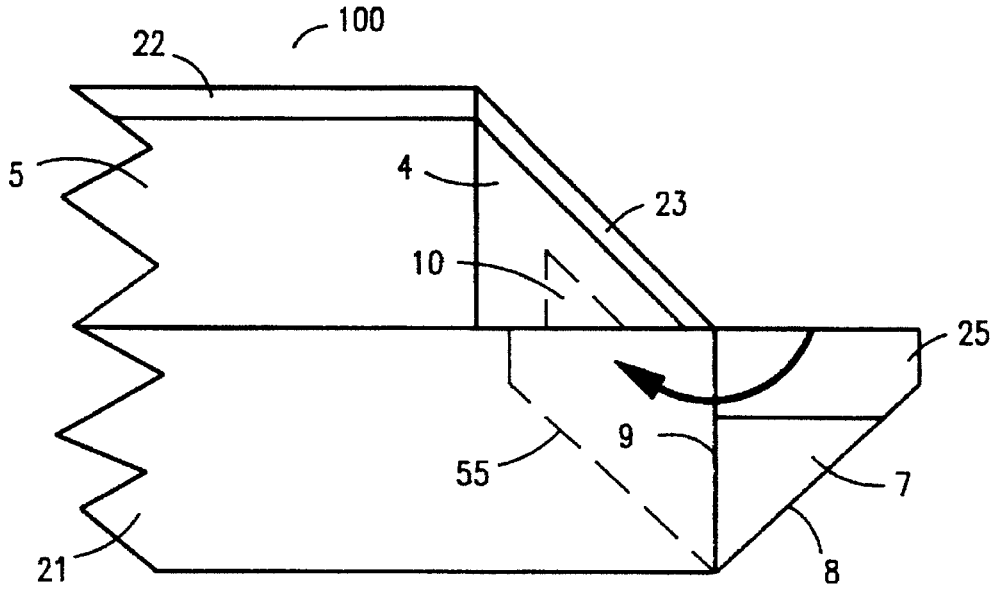
FIG. 3 is a detail of the folding procedure for one comer of the tray according to the present invention.

Referring now to FIG. 3, a detail of one corner of tray 100 showing the implementation of gusset 7 is shown. With reference to that figure, sides 21 and 22 are shown in the folded up position with respect to bottom 20 (not shown). In similar fashion, end 23 shown in the folded up position. The act of folding side 21 and end 23 forms flap 25 as shown. In this figure, flap 25 has been folded in the outward position for clarity. Gusset 7 is thus shown to consist of fold lines 8 and 9. To complete the assembly, flap 25 is folded in the direction shown to the border indicated at 55 and assembled by any of the previously discussed assembly methodologies.

With continued reference to FIG. 3, insulating sheet 4 is shown to be closely abutting insulating sheet 5. This proximal positioning of insulating sheets is common throughout the various insulating sheet junctures throughout the present invention and provides for an essentially continuous insulating barrier when tray 100 and cover 200 are assembled and fitted together.

Figure 4:
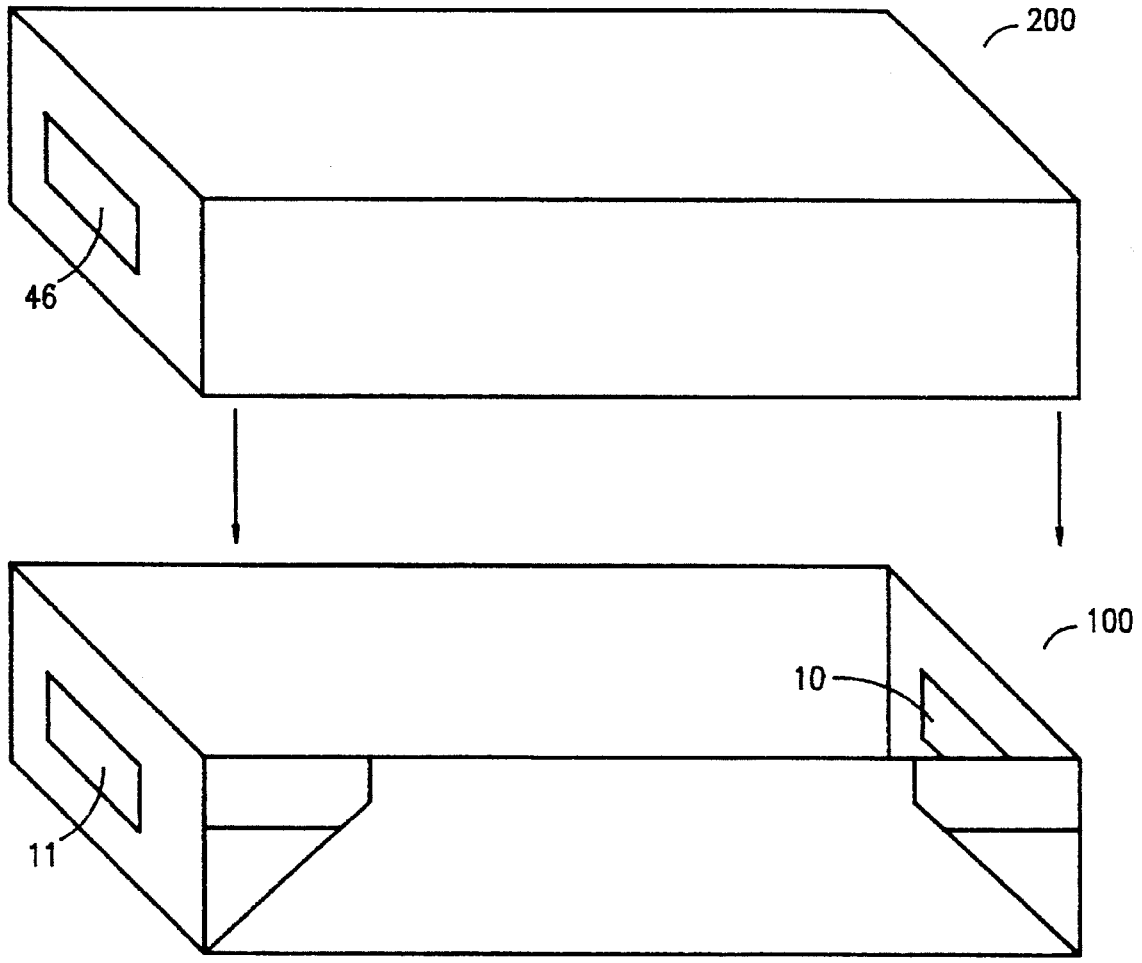
FIG. 4 is an isometric drawing showing the relationship of the cover to the tray of the present invention during assembly.

Referring now to FIG. 4, the positioning of cover 200 with respect to tray 100 is shown. In a preferred embodiment, cover 2 is a separate structure from tray 100 and is sized so that tray 100 is slidably receivable within cover 200. Also shown in this figure is the registry of ventilation port 46 on cover 200 with respect to ventilation port 11 on tray 100. In this manner, communication between the ambient atmosphere and the interior of tray 100 may be effected for the previously discussed temperature control reasons.

The present invention has been particularly shown and described with respect to certain preferred embodiments of features thereof. However, it should be readily apparent to those of ordinary skill in the art that various changes and modifications in form and detail may be made without departing from the spirit and scope of the invention as set forth in the appended claims. In particular, alternative packaging, insulating, waterproofing and assembly materials may, with equal facility, be implemented without departing from the teachings of the present invention. The invention disclosed herein may be practiced without any element which is not specifically disclosed herein.

Furthermore, while the description of the present invention has centered on its use in the floral produce industry, it is recognized that the principles of the present invention may, with equal facility, be utilized for the shipment of other commodities including meat, fish, seafood, or any other temperature and/or humidity-sensitive commodity. Such utilizations are specifically contemplated by the teachings of the present invention.

We claim:

1. Insulated waterproof produce shipping container comprising:

a one-piece waterproof tray formed with corner gussets to maintain unity of construction and watertight integrity;

a one-piece cover assembly into which said tray is slidably receivable; and a plurality of insulating panels affixed to the interior surfaces of said tray and said cover, suitable sized so that when said tray and said cover assembly are assembled, a substantially continuous insulating barrier is formed on the interior of said container.

* * * * *